US007346287B2

(12) United States Patent
Ogiyama et al.

(10) Patent No.: US 7,346,287 B2
(45) Date of Patent: Mar. 18, 2008

(54) TRANSFER DEVICE FOR FORMING A STABLE TRANSFER ELECTRIC FIELD, AND AN IMAGE FORMING APPARATUS INCLUDING THE TRANSFER DEVICE

(75) Inventors: Hiromi Ogiyama, Setagaya-ku (JP); Kohki Katoh, Meguro-ku (JP); Akihiro Sugino, Numazu (JP); Mitsuru Takahashi, Kawasaki (JP); Katsuya Kawagoe, Ohta-ku (JP); Yuuji Sawai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/352,213

(22) Filed: Feb. 13, 2006

(65) Prior Publication Data

US 2006/0127116 A1 Jun. 15, 2006

Related U.S. Application Data

(62) Division of application No. 10/282,039, filed on Oct. 29, 2002, now abandoned.

(30) Foreign Application Priority Data

Oct. 29, 2001 (JP) ..... 2001-330505

(51) Int. Cl.
*G03G 15/01* (2006.01)

(52) U.S. Cl. ..... 399/66

(58) Field of Classification Search ..... 399/45, 399/66, 297, 302, 308, 313
See application file for complete search history.

(56) References Cited

U.S. PATENT DOCUMENTS 3,781,105 A 12/1973 Meagher (Continued)

FOREIGN PATENT DOCUMENTS

JP 08-095400 4/1996

(Continued)

OTHER PUBLICATIONS

U.S. Appl. No. 11/561,983, filed Nov. 21, 2006, Sugino, et al.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

A transfer device transfers a visual image from an image carrier to a recording medium. The transfer device includes a first transfer element that moves and receives the visual image from the image carrier on a first surface of the first transfer element, a second transfer element provided opposite to the first surface of the first transfer element to pinch and convey the recording medium through a secondary transfer nip part, a facing roller provided on a second surface of the first transfer element opposite to the first surface thereof, and a constant-current power supply that applies an electric current voltage to a core metal of the facing roller to transfer the visual image from the first transfer element to the recording medium. The electric current voltage applied to the core metal has a polarity equal to a polarity of the visual image and is subjected to a constant-current control.

12 Claims, 9 Drawing Sheets

U.S. PATENT DOCUMENTS

| | | | |
|---|---|---|---|
| 4,652,110 | A | 3/1987 | Sato et al. |
| 5,101,239 | A | 3/1992 | Nishikawa et al. |
| 5,300,984 | A | 4/1994 | Fuma et al. |
| 5,596,391 | A | 1/1997 | Matsushita et al. |
| 5,729,811 | A | 3/1998 | Takahata et al. |
| 6,075,965 | A | 6/2000 | Tombs et al. |
| 6,097,924 | A | 8/2000 | Okuyama |
| 6,341,205 | B1 | 1/2002 | Yoshino et al. |
| 6,567,625 | B1 | 5/2003 | Tatematsu et al. |
| 6,728,505 | B2 | 4/2004 | Omata et al. |

FOREIGN PATENT DOCUMENTS

| | | | |
|---|---|---|---|
| JP | 10-186879 | | 7/1998 |
| JP | 11-024439 | | 1/1999 |
| JP | 11024451 | A * | 1/1999 |
| JP | 11-161061 | | 6/1999 |
| JP | 2000019854 | A * | 1/2000 |
| JP | 2001-117390 | | 4/2001 |
| JP | 2001-154433 | | 6/2001 |
| JP | 2002-055535 | | 2/2002 |

OTHER PUBLICATIONS

U.S. Appl. No. 11/608,599, filed Dec. 8, 2006, Sawai.
U.S. Appl. No. 11/588,340, filed Oct. 27, 2006, Saeki, et al.
U.S. Appl. No. 11/740,570, filed Apr. 26, 2007, Kawagoe.
U.S. Appl. No. 11/739,391, filed Apr. 24, 2007, Yokokawa et al.
U.S. Appl. No. 11/748,511, filed May 15, 2007, Sawai, et al.
U.S. Appl. No. 11/757,661, filed Jun. 4, 2007, Sawai, et al.
U.S. Appl. No. 11/759,008, filed Jun. 6, 2007, Sawai.
U.S. Appl. No. 11/762,296, filed Jun. 13, 2007, Gondoh, et al.

* cited by examiner

TRANSFER DEVICE FOR FORMING A STABLE TRANSFER ELECTRIC FIELD, AND AN IMAGE FORMING APPARATUS INCLUDING THE TRANSFER DEVICE

CROSS-REFERENCE TO RELATED APPLICATIONS

The present application is a divisional of U.S. application Ser. No. 10/282,039, filed Oct. 29, 2002 now abandoned, and in turn claims priority to Japanese Patent Application No. 2001-3305 05 filed in the Japanese Patent Office on Oct. 29, 2001, the disclosure of each of which is incorporated herein by reference.

BACKGROUND OF THE INVENTION

1. Field of the Invention

The present invention relates to an electrophotographic image forming apparatus including a transfer device such as a copying machine, a laser printer, a facsimile machine, or other similar image forming apparatus, and more particularly to a transfer device in which a toner image formed on a photoreceptor is primarily transferred to an intermediate transfer element and is secondarily transferred from the intermediate transfer element to a recording medium such as a sheet, etc.

2. Discussion of the Background

An image forming apparatus including a transfer device, in which a toner image formed on a photoreceptor is primarily transferred to an intermediate transfer element and is secondarily transferred from the intermediate transfer element to a recording medium, has been widely used. For example, Japanese Laid-open Patent Publication Nos. 10-186879 and 11-161061 describe such background image forming apparatuses.

In a background multi-color image forming apparatus including a transfer device, latent images formed on a photoreceptor are developed with toner of different colors by color developing devices and are formed into toner images of different colors. The toner images of different colors are sequentially transferred from the photoreceptor to a transfer belt as an intermediate transfer element by a primary transfer device while being superimposed upon each other on the transfer belt in a primary transfer process.

Subsequently, the superimposed color toner image on the transfer belt is moved to a secondary transfer device. Until all the toner images of different colors are primarily transferred to the transfer belt, the color toner image already transferred to the transfer belt just passes the secondary transfer device. Upon completion of the primary transfer process, a secondary transfer process is started by the secondary transfer device.

FIG. 7A illustrates one type of a background secondary transfer device that performs a secondary transfer process. The secondary transfer device of FIG. 7A includes a transfer roller 50*a* and a back-up roller 60*a*. A voltage is applied to a core metal of the transfer roller 50*a* from a high-voltage power supply 40*a*. The back-up roller 60*a* is provided opposite to the transfer roller 50*a* via a transfer belt 100*a* and is electrically grounded. A superimposed color toner image on the transfer belt 100*a* is transferred to a recording medium "S," which is fed to a transfer nip part formed between the transfer belt 100*a* and the transfer roller 50*a* in synchronism with the movement of the superimposed color toner image, under the influence of a transfer electric field formed by the transfer roller 50*a*.

FIGS. 7B and 7C illustrate other types of background secondary transfer devices. The secondary transfer device of FIG. 7B includes a transfer roller 50*b*, a back-up roller 60*b*, and a contact roller 70. The back-up roller 60*b* is provided opposite to the transfer roller 50*b* via a transfer belt 100*b*. The contact roller 70 is rotatably provided in contact with an upper circumferential surface of the back-up roller 60*b*. A voltage is applied to the contact roller 70 from a power supply 40*b*.

The secondary transfer device of FIG. 7C includes a transfer roller 50*c* and a back-up roller 60*c*. The back-up roller 60*c* is provided opposite to the transfer roller 50*c* via a transfer belt 100*c*. A voltage is applied to a core metal of the back-up roller 60*c* from a power supply 40*c*.

In the secondary transfer device of FIG. 7B, a superimposed color toner image on the transfer belt 100*b* is transferred to a recording medium "S," which is fed to a transfer nip part formed between the transfer belt 100*b* and the transfer roller 50*b*, under the influence of a transfer electric field formed by the contact roller 70. In the secondary transfer device of FIG. 7C, a superimposed color toner image on the transfer belt 100*c* is transferred to a recording medium "S," which is fed to a transfer nip part formed between the transfer belt 100*c* and the transfer roller 50*c*, under the influence of a transfer electric field formed by the back-up roller 60*c*.

In the secondary transfer device of FIG. 7A in which a transfer electric field is formed by the transfer roller 50*a*, when an electric resistance of the recording medium "S" is low, electric current may flow into the recording medium "S" and leak to a member other than the transfer belt 100*a* which contacts the recording medium "S," resulting in a reactive electric current. In this condition, because an amount of electric current used for forming the transfer electric field decreases, the transfer electric field is reduced. Thus, an image transfer efficiency tends to be decreased.

In the secondary transfer devices of FIGS. 7B and 7C in which a transfer electric field is formed on the side of the back-up roller, a problem resulting from the decrease of image transfer efficiency may be obviated. However, when forming a transfer electric field by the contact roller 70, the resistance of a semiconducting tube provided in a surface portion of the back-up roller 60*b* tends to be uneven. As a result, the transfer electric field tends to be relatively unstable. Further, when forming a transfer electric field by the core metal of the back-up roller 60*c*, a problem resulting from the resistance unevenness does not occur. However, when the width of the recording medium "S" is small, an excessive amount of electric current flows to an area of the transfer belt 100*c* outside the recording medium "S" where the transfer roller 50*c* is in direct contact with the transfer belt 100*c*. As a result, damage may be caused to the device, and a desired transfer electric field may not be formed.

SUMMARY OF THE INVENTION

According to a first aspect of the present invention, a transfer device that transfers a visual image from an image carrier to a recording medium, includes a first transfer element configured to move and receive the visual image from the image carrier on a first surface of the first transfer element. The first transfer element is in a shape of a belt. The transfer device further includes a second transfer element provided opposite to the first surface of the first transfer element to pinch and convey the recording medium through a transfer nip part formed between the first surface of the first transfer element and the second transfer element, and a facing roller provided on a second surface of the first transfer element opposite to the first surface of the first transfer element.

The facing roller faces the second transfer element via the first transfer element and includes a core metal functioning as an electrode, and an elastic member of medium resistance formed around the core metal. The transfer device further includes a constant-current power supply configured to apply an electric current voltage to the core metal of the facing roller to transfer the visual image on the first surface of the first transfer element to the recording medium. The electric current voltage applied to the core metal has a polarity equal to a polarity of the visual image and is subjected to a constant-current control.

According to another aspect of the present invention, a transfer device that transfers a visual image from an image carrier to a recording medium, includes a first transfer element configured to move and receive the visual image from the image carrier on a first surface of the first transfer element, a second transfer element provided opposite to the first surface of the first transfer element to pinch and convey the recording medium through a transfer nip part formed between the first surface of the first transfer element and the second transfer element, and a facing member provided on a second surface of the first transfer element opposite to the first surface of the first transfer element.

The facing member faces the second transfer element via the first transfer element and includes an electrode. The transfer device further includes a constant-current power supply configured to apply an electric current voltage to the electrode of the facing member to transfer the visual image on the first surface of the first transfer element to the recording medium at the transfer nip part, and an electric current detecting device configured to detect an amount of an electric current passing through the recording medium. The electric current detecting device is provided upstream of the transfer nip part in a direction of conveyance of the recording medium. The transfer device further includes a discharging device configured to discharge charge deposited on the recording medium. The discharging device is provided downstream of the transfer nip part in the direction of conveyance of the recording medium. The electric current voltage applied to the electrode has a polarity equal to a polarity of the visual image and is subjected to a constant-current control.

The present invention also relates to an image transferring method.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
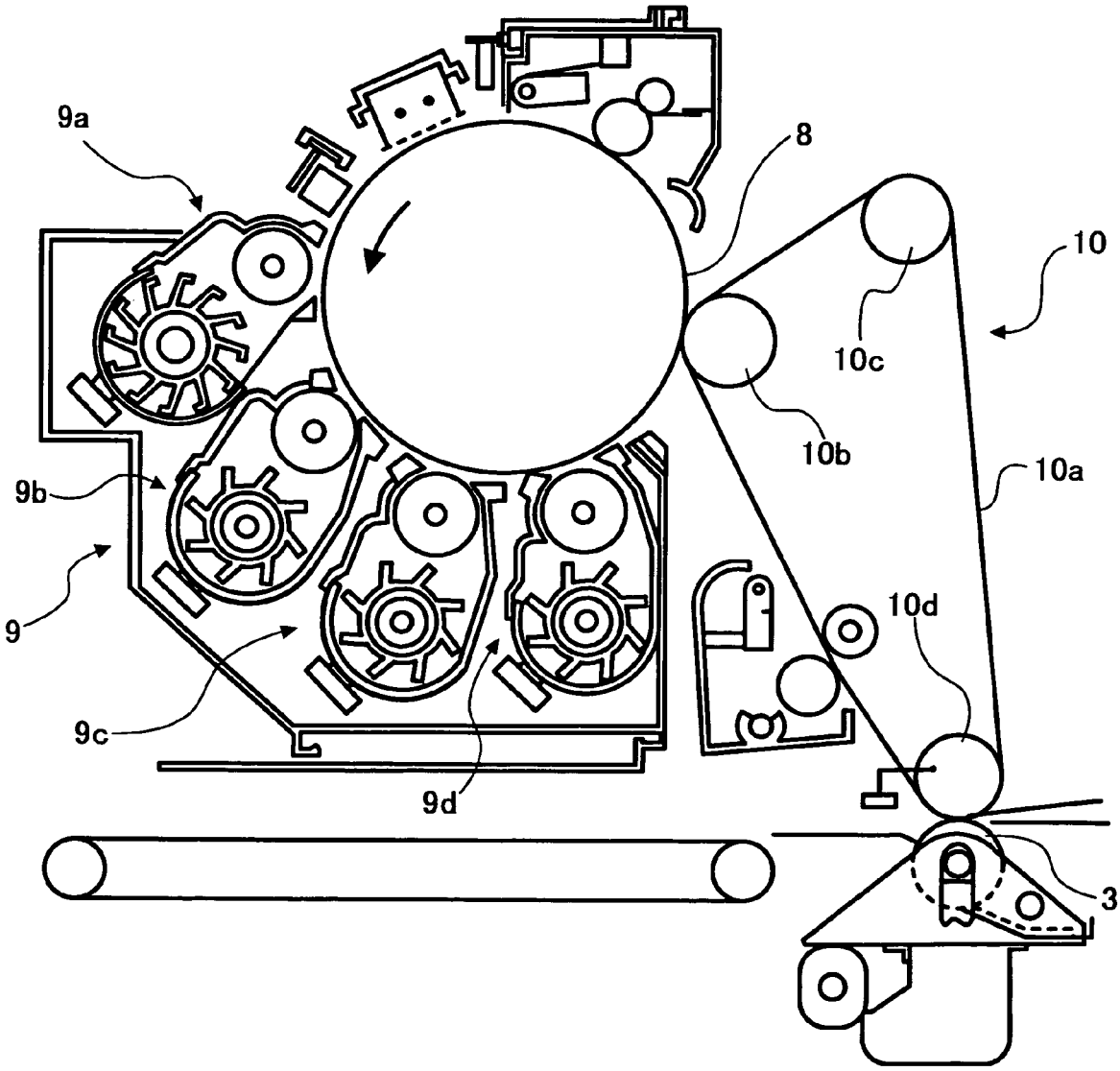
FIG. 1 is a schematic view of an image forming section of an image forming apparatus including a transfer device according to one embodiment of the present invention.

Preferred embodiments of the present invention are described in detail referring to the drawings, wherein like reference numerals designate identical or corresponding parts throughout the several views.

FIG. 1 is a schematic view of an image forming section of an image forming apparatus including a transfer device according to one embodiment of the present invention. In FIG. 1, the transfer device is schematically illustrated based on the basic concept of the present invention.

Referring to FIG. 1, the image forming section of the image forming apparatus includes a drum-shaped photoreceptor 8 serving as an image carrier driven to rotate in a direction indicated by the arrow in FIG. 1. Arranged around the photoreceptor 8 are devices for performing charging, exposing, developing, transferring, discharging, and cleaning processes, etc. In the image forming section of FIG. 1, a developing device 9 and a transfer device 10 are illustrated as main devices.

Referring to FIG. 1, electrostatic latent images formed on the photoreceptor 8 are developed with toner of different colors by the developing device 9 and are formed into toner images of different colors. The developing device 9 includes developing units 9*a*, 9*b*, 9*c*, and 9*d* that contain toner of different colors. The toner images of different colors are formed by a known electrophotographic image forming process, and the description of the electrophotographic image forming process is omitted here.

The toner images of different colors are sequentially transferred from the photoreceptor 8 to an endless belt-shaped intermediate transfer element 10*a* as a first transfer element in the transfer device 10 at a primary transfer station (hereafter referred to as a "primary transfer"). When forming toner images of four colors, primary transfer operations are repeated four times.

The intermediate transfer element 10*a* is rotatably spanned around three support rollers 10*b*, 10*c*, and 10*d*. The support roller 10*b* opposes the photoreceptor 8 via the intermediate transfer element 10*a*, and the primary transfer station is formed between the photoreceptor 8 and the support roller 10*b*.

The support roller 10*d* opposes a transfer element 3 of a contact transfer type as a second transfer element via the intermediate transfer element 10*a*, and a secondary transfer station is formed between the support roller 10*d* and the transfer element 3. The transfer element 3 is configured to be brought into contact with and separated from the intermediate transfer element 10*a*. Until all of the toner images of different colors are transferred from the photoreceptor 8 to the intermediate transfer element 10*a*, the transfer element 3 is separated from the intermediate transfer element 10*a*. After the toner images of different colors are transferred to the intermediate transfer element 10*a* while being superimposed upon each other on the intermediate transfer element

10*a*, the transfer element 3 is automatically switched to be brought into contact with the intermediate transfer element 10*a*.

A recording medium is fed from a recording medium feeding device (not shown) to the secondary transfer station at a timing such that a leading edge of the superimposed color toner image on the intermediate transfer element 10*a* is aligned with a leading edge of the recording medium, and is sandwiched between the intermediate transfer element 10*a* and the transfer element 3. The superimposed color toner image on the intermediate transfer element 10*a* is transferred to the recording medium at the secondary transfer station by the action of a predetermined transfer electric field (hereafter referred to as a "secondary transfer").

Figure 2:
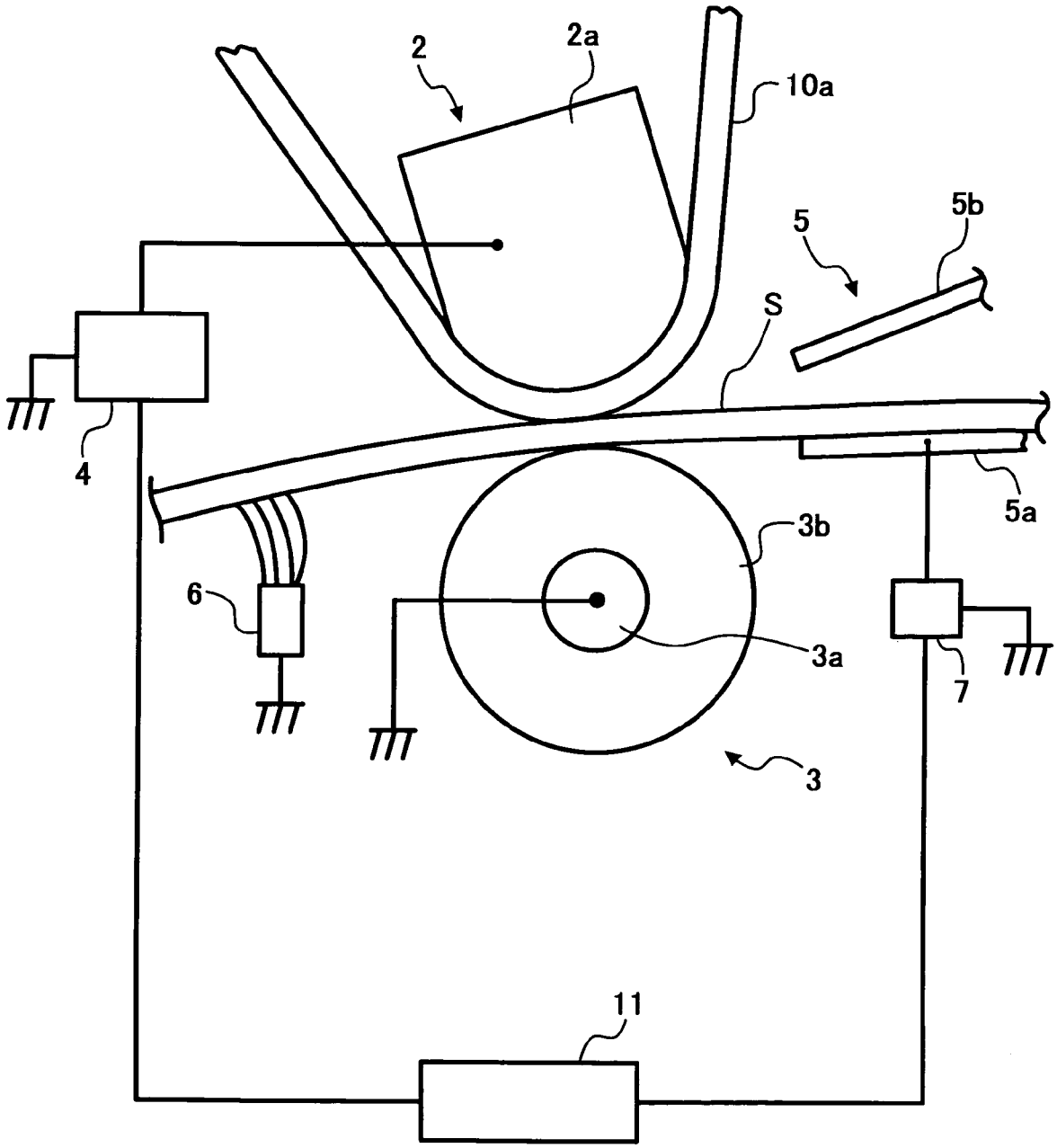
FIG. 2 is a schematic enlarged view of a construction of the transfer device at a secondary transfer station according to one embodiment of the present invention.

Next, the details of the construction of the transfer device 10 at the secondary transfer station will be described. FIG. 2 is a schematic enlarged view of a construction of the transfer device 10 at the secondary transfer station according to one embodiment of the present invention.

Referring to FIG. 2, the transfer device 10 includes a facing member 2 in place of the support roller 10*d* in FIG. 1. The facing member 2 is a fixed member formed from a metallic electric conductor 2*a* functioning as an electrode. The part of the electric conductor 2*a* in contact with the intermediate transfer element 10*a* is processed to have smoothness to reduce the frictional resistance between the electric conductor 2*a* and the intermediate transfer element 10*a*.

The transfer element 3 is shaped in the form of a roller and includes a core metal 3*a*, and an elastic member 3*b* formed around the core metal 3*a*. A high-voltage constant-current power supply 4 applies a predetermined constant current voltage to the electric conductor 2*a* of the facing member 2.

The transfer device 10 further includes a recording medium guide device 5 including a lower guide plate 5*a* and an upper guide plate 5*b* to guide a recording medium "S" to a secondary transfer nip part formed between the intermediate transfer element 10*a* and the transfer element 3.

The transfer device 10 further includes a discharging device 6 and an electric current detecting device 7. The discharging device 6 is provided downstream of the secondary transfer nip part in a direction of conveyance of the recording medium "S" to remove static electricity from the recording medium "S" after a superimposed color toner image is transferred from the intermediate transfer element 10*a* to the recording medium "S" at the secondary transfer nip part.

Figure 6:
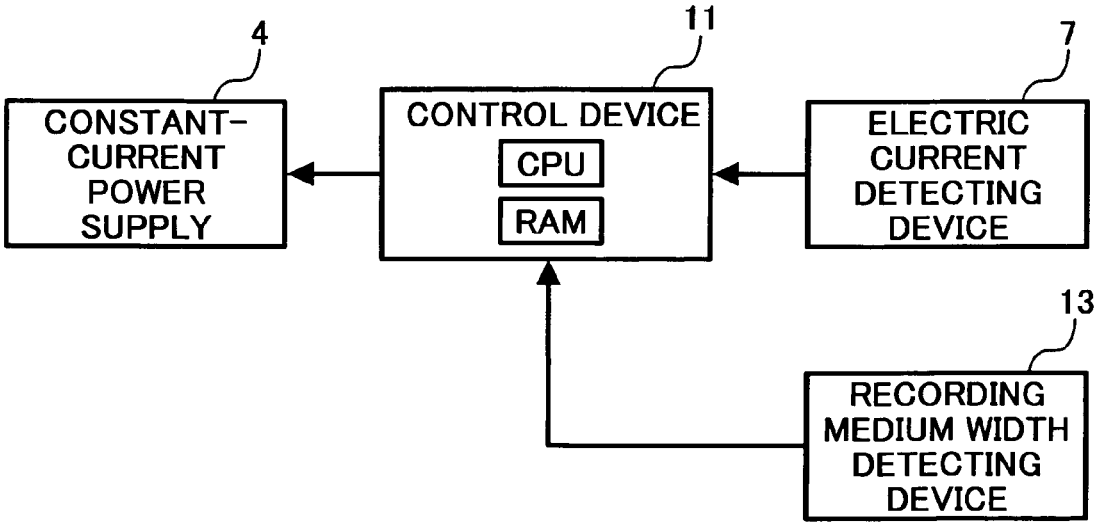
FIG. 6 is a block diagram of a control device in the transfer device according to the embodiments of the present invention.
Figure 7A:
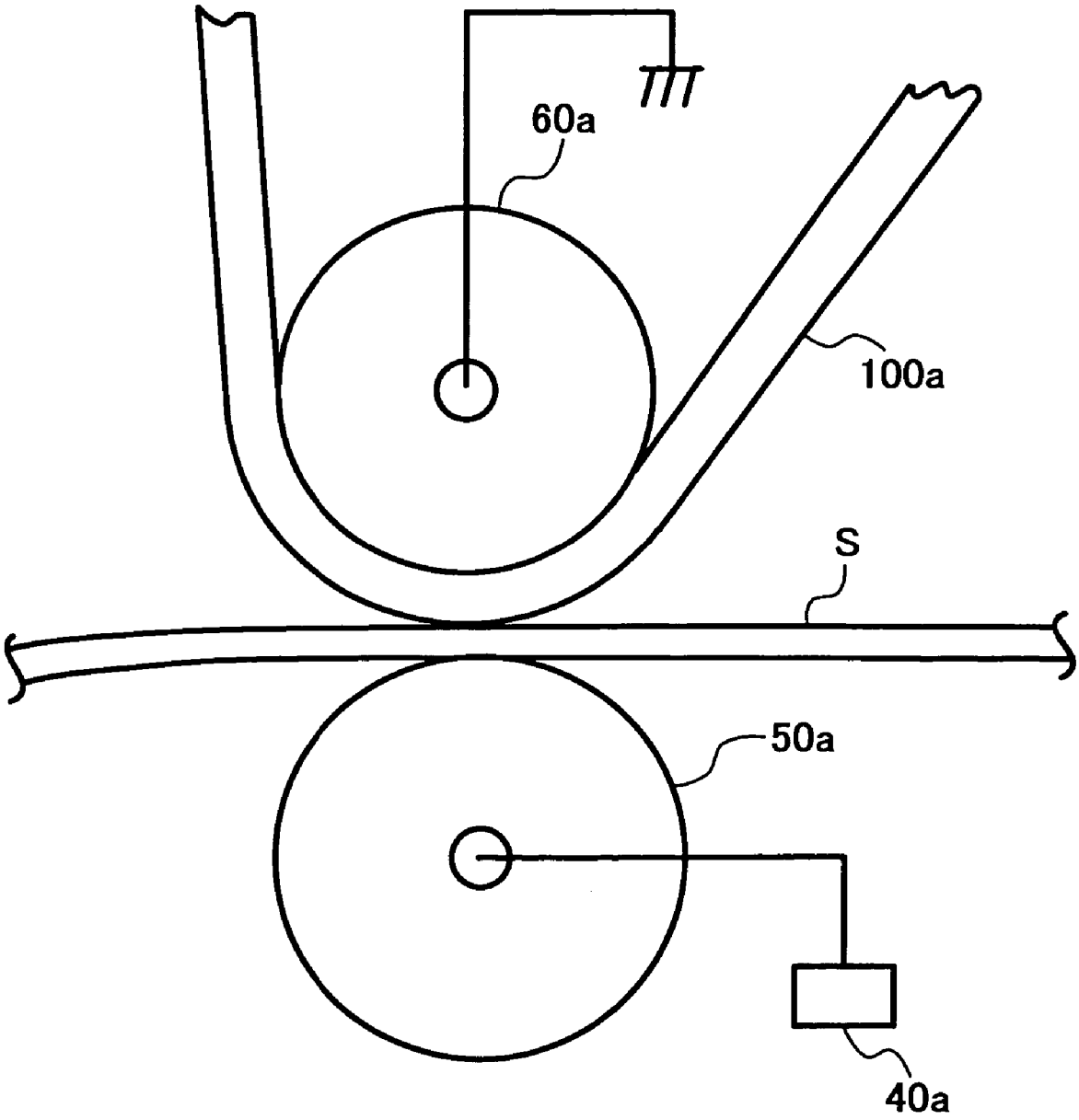
FIG. 7A BACKGROUND ART
FIGS. 7A through 7C are schematic views of background secondary transfer devices.
Figure 7B:
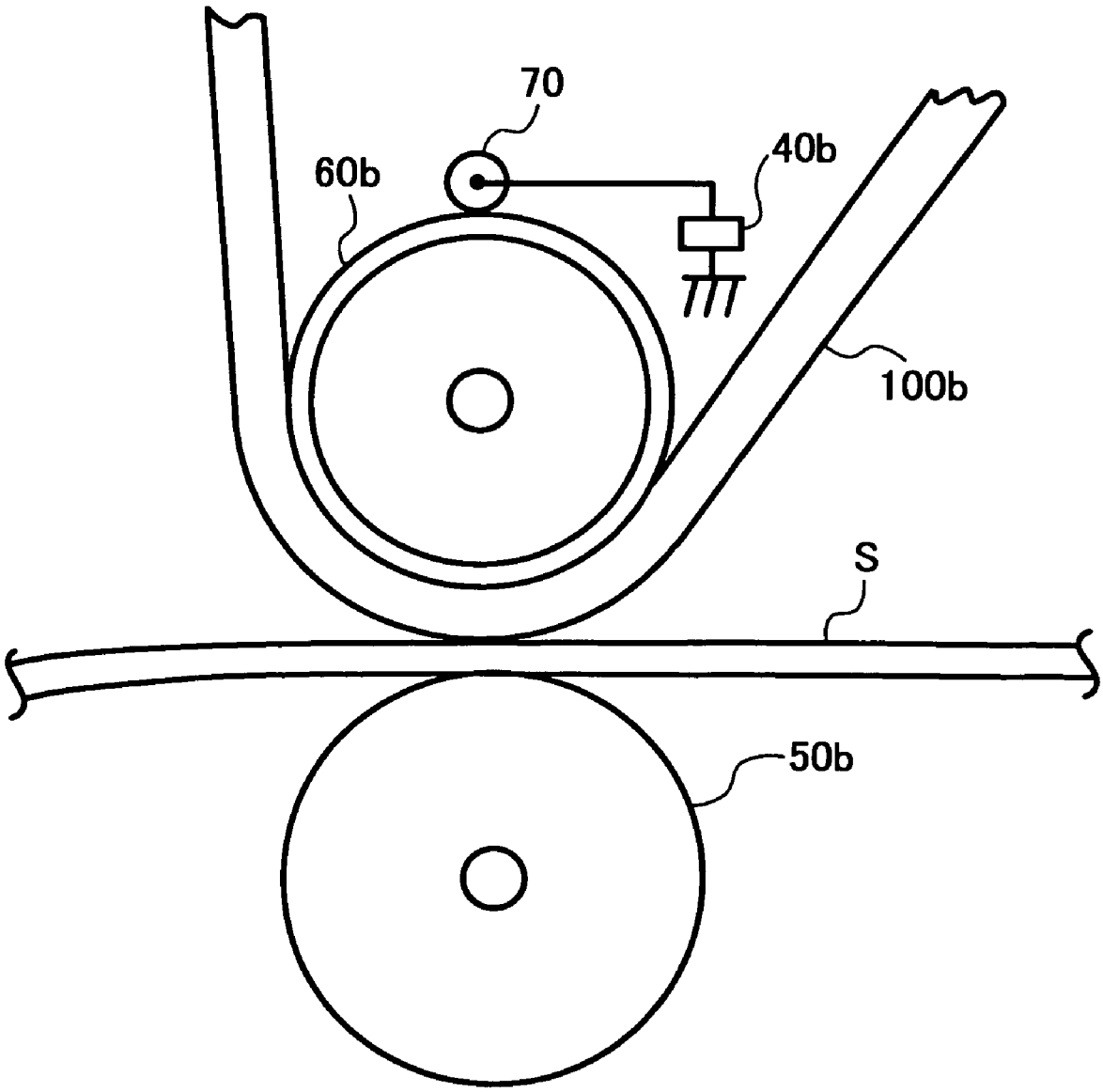
FIG. 7B BACKGROUND ART
Figure 7C:
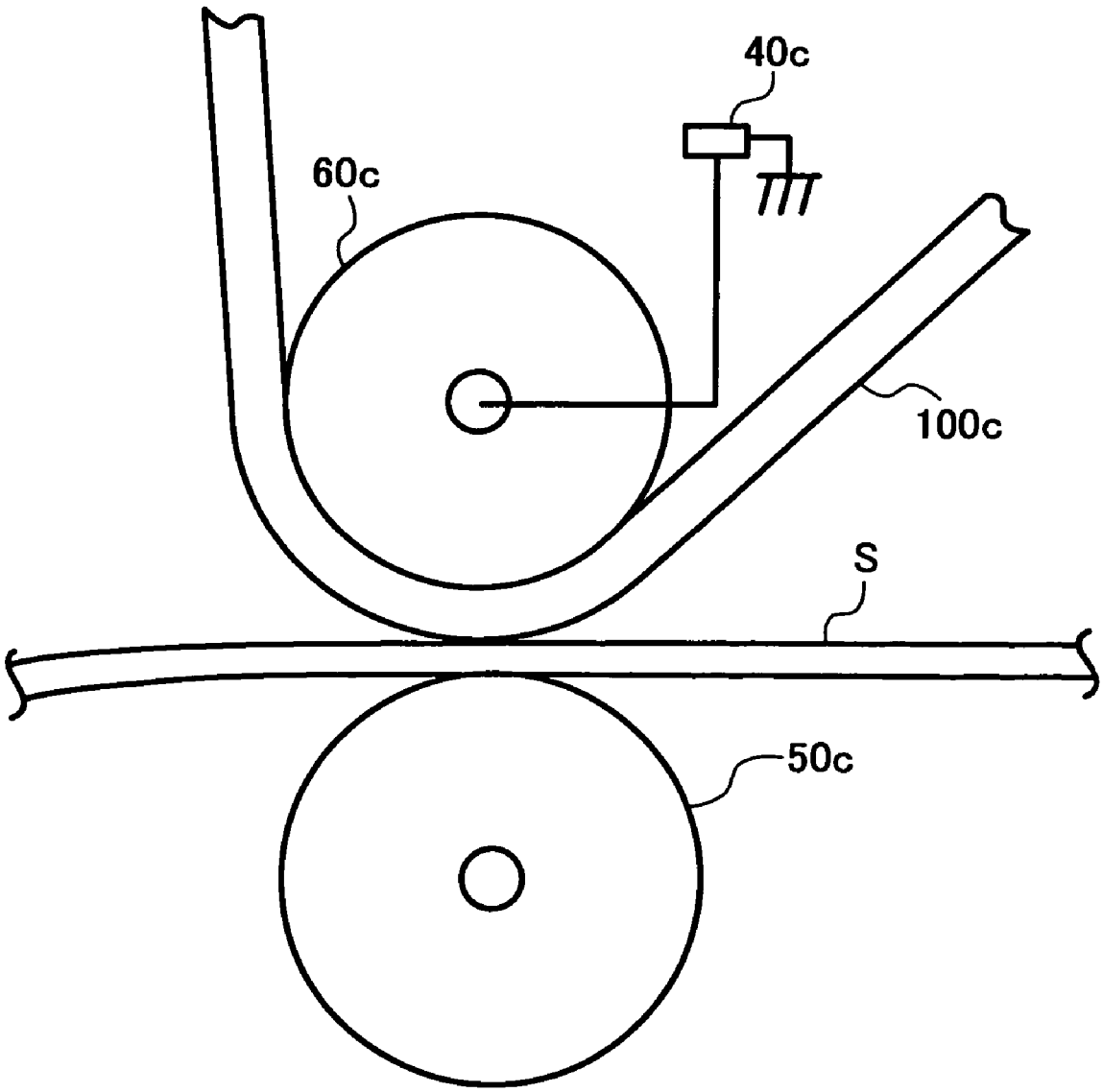
FIG. 7C BACKGROUND ART

The electric current detecting device 7 is provided on the lower guide plate 5*a* at an upstream side of the secondary transfer nip part in the direction of conveyance of the recording medium "S" to detect a value of electric current flowing into the lower guide plate 5*a* through the recording medium "S" to detect an amount of an electric current passing through the recording medium "S". Each of the core metal 3*a*, the constant-current power supply 4, the discharging device 6, and the electric current detecting device 7 is electrically grounded. As illustrated in FIGS. 2 and 6, the constant-current power supply 4 and the electric current detecting device 7 are connected to a control device 11 including a central processing unit (CPU) and a random-access memory (RAM), etc.

When the superimposed color toner image on the intermediate transfer element 10*a* moves into the secondary transfer station, the recording medium "S" is fed out from the recording medium feeding device (not shown) at a timing such that a leading edge of the superimposed color toner image on the intermediate transfer element 10*a* is aligned with a leading edge of the recording medium "S", and is pinched and conveyed through the secondary transfer station. Substantially simultaneously, an electric field having a polarity equal to that of the superimposed color toner image is formed toward the transfer element 3 by applying a constant-current voltage from the constant-current power supply 4 to the electric conductor 2*a* of the facing member 2. The superimposed color toner image on the intermediate transfer element 10*a* is transferred to the recording medium "S" by the action of the electric field.

Figure 3:
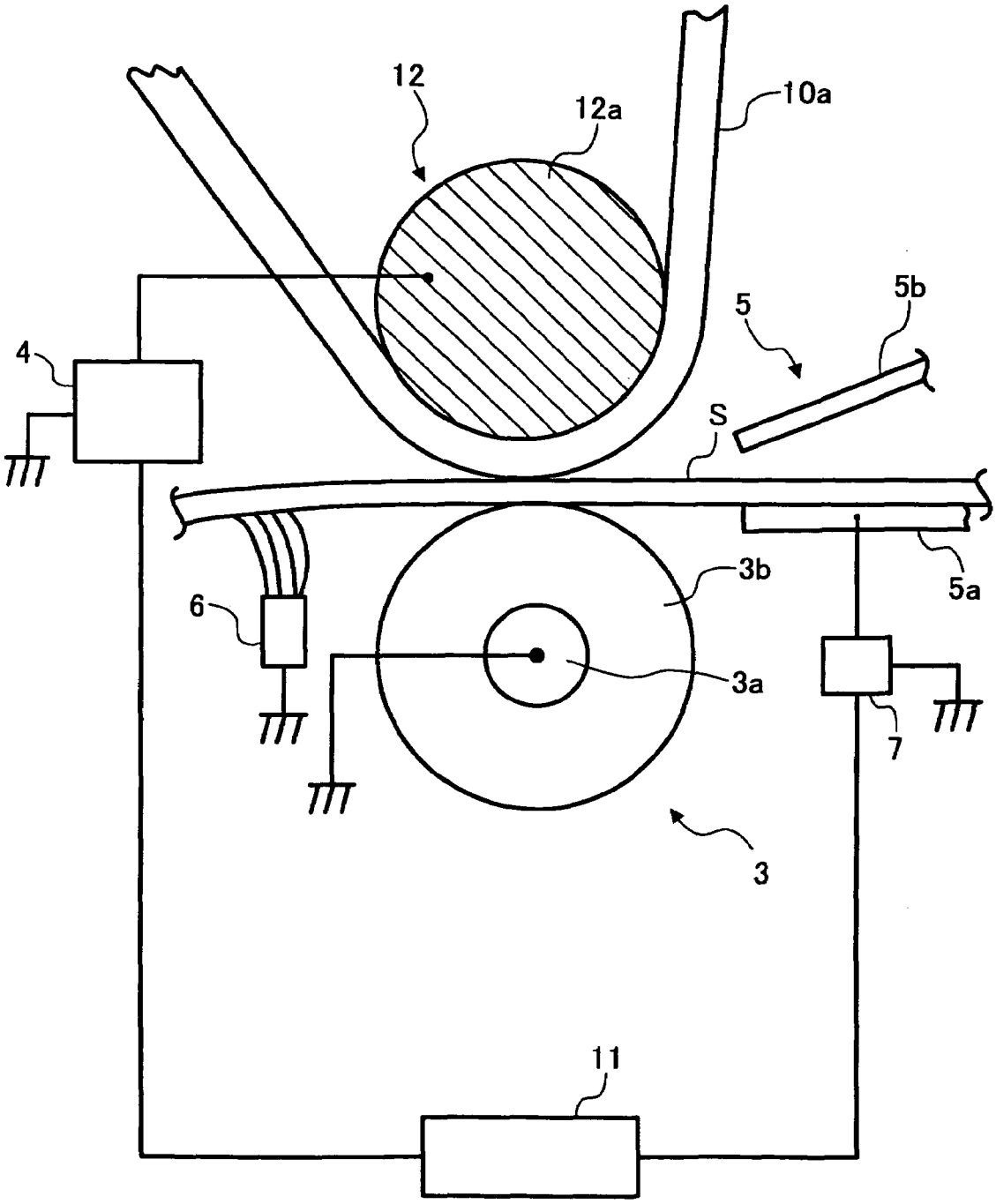
FIG. 3 is a schematic enlarged view of a construction of the transfer device at a secondary transfer station according to an alternative embodiment of the present invention.

FIG. 3 is a schematic enlarged view of a construction of the transfer device 10 at the secondary transfer station according to an alternative embodiment of the present invention. Referring to FIG. 3, the transfer device 10 includes a facing member 12 in place of the facing member 2 in FIG. 2. The facing member 12 is formed from ϵ metallic electric conductive roller 12*a* functioning as an electrode. In the transfer device 10 of FIG. 3, the electric conductive roller 12*a* may be rotated by movement of the intermediate transfer element 10*a* or the electric conductive roller 12*a* may function as a drive roller that drives the intermediate transfer element 10*a* to move. As compared to the facing member 2 in FIG. 2, the frictional resistance between the facing member 12 and the intermediate transfer element 10*a* is reduced. Thus, the abrasion and damage to the intermediate transfer element 10*a* can be prevented.

Figure 4:
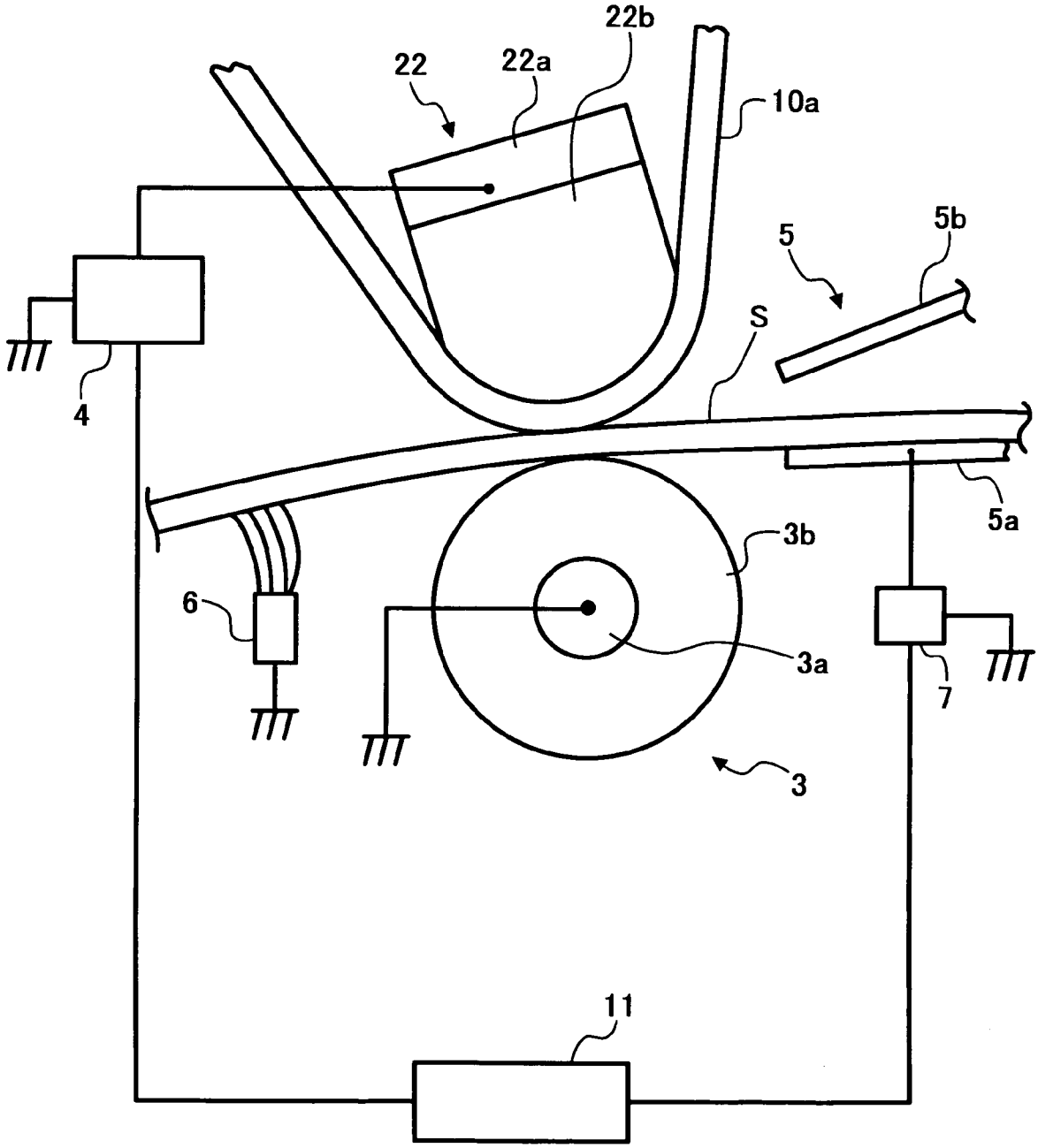
FIG. 4 is a schematic enlarged view of a construction of the transfer device at a secondary transfer station according to another alternative embodiment of the present invention.

FIG. 4 is a schematic enlarged view of a construction of the transfer device 10 at the secondary transfer station according to another alternative embodiment of the present invention. Referring to FIG. 4, the transfer device 10 includes a facing member 22 in place of the facing member 2 in FIG. 2. The facing member 22 is a fixed member including an electric conductor 22*a* functioning as an electrode and a medium resistance element 22*b*. At least the part of the medium resistance element 22*b* in contact with the intermediate transfer element 10*a* is processed to have smoothness so as to reduce the frictional resistance between the medium resistance element 22*b* and the intermediate transfer element 10*a*.

With the construction in which the electric conductor 22*a* functioning as an electrode is not in direct contact with the intermediate transfer element 10*a*, the discharge breakdown in the intermediate transfer element 10*a* may be prevented. Further, in the transfer device 10 in FIG. 4 in which the medium resistance element 22*b* is interposed between the electric conductor 22*a* and the intermediate transfer element 10*a*, the thickness of the medium resistance element 22*b* can be secured to a sufficient degree. Further, because the facing member 22 is provided in a stationary manner, a transfer electric field may be formed stably. Thus, image transfer efficiency may be increased and a high quality image may be obtained.

Figure 5:
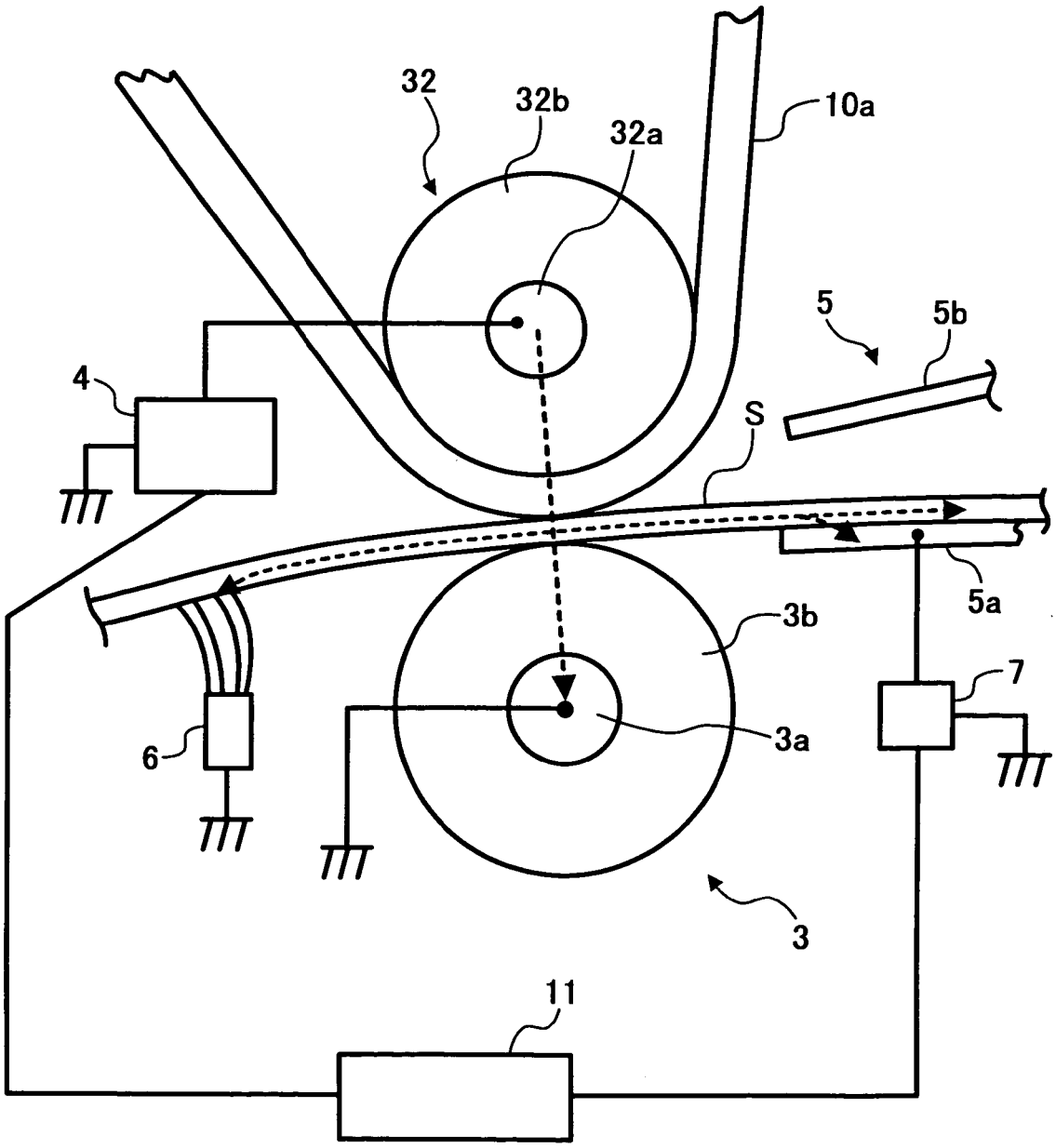
FIG. 5 is a schematic enlarged view of a construction of the transfer device at a secondary transfer station according to another alternative embodiment of the present invention.

FIG. 5 is a schematic enlarged view of a construction of the transfer device 10 at the secondary transfer station according to another alternative embodiment of the present invention. Referring to FIG. 5, the transfer device 10 includes a facing member 32 in place of the facing member 12 in FIG. 3. The facing member 32 is shaped in the form of a roller including a core metal 32*a* functioning as an electrode and an elastic member 32*b* of medium resistance as a medium resistance element formed around the core metal 32*a*.

With the construction in which the core metal 32*a* functioning as an electrode is not in direct contact with the intermediate transfer element 10*a*, the discharge breakdown in the intermediate transfer element 10*a* may be prevented. Further, in the transfer device 10 of FIG. 5, the thickness of the elastic member 32*b* of medium resistance is secured to a sufficient degree. Therefore, even though the position of the part of the elastic member 32*b* contributing to the transfer electric field changes by rotation of the facing member 32, a stable transfer electric field can be formed with a very few fluctuation of a resistance value between the core metal 32*a* of the facing member 32 and the core metal 3*a* of the transfer element 3.

As illustrated by the dotted lines in FIG. 5, transfer electric currents corresponding to respective resistance values flow into the intermediate transfer element 10*a*, the recording medium "S," and the transfer element 3 during a secondary transfer process. In addition, depending on the resistance value of the recording medium "S," there are further electric currents flowing into the discharging device 6 and the lower guide plate 5*a* through the recording medium "S."

In the transfer device 10 illustrated in FIGS. 2 through 5, the electrode is provided to form a transfer electric field on the side of the intermediate transfer element 10*a* opposite to the side thereof on which a toner image is carried. Therefore, the above-described electric currents flowing into the discharging device 6 and the lower guide plates 5*a* through the recording medium "S" illustrated by the dotted lines in FIG. 5 do not cause the decrease of the image transfer efficiency, because the flow of the electric currents into the discharging device 6 and the lower guide plates 5*a* occurs after the transfer electric currents from the electrode are used for transferring a toner image from the intermediate transfer element 10*a* to the recording medium "S." Further, as the transfer electric current voltage applied from the constant-current power supply 4 to the electrode is subjected to a constant-current control, an amount of transfer electric currents contributing to the transfer electric field is controlled to be constant, so that a stable transfer of a toner image can be performed.

With regard to a resistance value between the electrode of the facing member and the core metal 3*a* of the transfer element 3, as the resistance value increases, the influence of the fluctuation of the resistance value of the recording medium "S" on the image transfer efficiency decreases. However, if the resistance value between the electrode of the facing member and the core metal 3*a* of the transfer element 3 is too large, to secure a value of electric currents required to maintain the image transfer efficiency, an electric current voltage applied from the constant-current power supply 4 to the electrode of the facing member must be increased. As a result, a large hi-voltage power supply becomes necessary.

Especially, if the resistance of the medium resistance element of the facing member increases, the time constant of the attenuation of electric charge increases, so that the electric charge remains and accumulates in the medium resistance element. In this condition, the recording medium "S" may not be completely separated from the intermediate transfer element 10*a*, and the transfer electric field may be badly influenced.

When the resistance value between the electrode of the facing member and the core metal 3*a* of the transfer element 3 is low and when the width of the recording medium "S" is small, a large amount of reactive electric current flows to an area of the intermediate transfer element 10*a* outside the recording medium "S" where the intermediate transfer element 10*a* is in direct contact with the transfer element 3. Thus, a desired transfer electric field is hard to secure. For the above-described reasons, at least the resistance value of the medium resistance element of the facing member is preferably in a range of approximately $10^6$ Ωcm to approximately $10^{12}$ Ωcm. By setting the resistance value of the medium resistance element to the above-described range, a desirable transfer result may be obtained without specifying the resistance value of the elastic member 3*b* of the transfer element 3. However, it is preferable that the resistance value of the elastic member 3*b* of the transfer element 3 is set to be substantially equal to that of the medium resistance element of the facing member.

When the low resistance value is selected from the above-described range of the resistance value of the medium resistance element of the facing member and when the width of the recording medium "S" is small, the above-described reactive electric current may not be neglected depending on the resistance value of the recording medium "S". In this instance, it is preferable that the value of the electric current applied from the constant-current power supply 4 to the electrode of the facing member should be controlled to be changed from a reference value according to the width of the recording medium "S."

For example, a recording medium width detecting device 13 detects (see FIG. 6) the width of the recording medium "S" after each of recording media "S" is fed out from the recording medium feeding device (not shown). As illustrated in FIG. 6, the recording medium width detecting device 13 is connected to the control device 11. The control device 11 calculates a difference between a maximum width of the recording medium "S" used in the image forming apparatus and the width of the recording medium "S" detected by the recording medium width detecting device 13. The control device 11 further calculates an electric current value by multiplying the difference by a predetermined constant. Subsequently, the control device 11 controls the constant-current power supply 4 to apply an electric current, in which the above-described calculated electric current value is added to a reference constant current value, to the electrode such as the electric conductor 2*a*, the electric conductive roller 12*a*, the electric conductor 22*a*, and the core metal 32*a*.

The above-described reactive electric current tends to increase as the resistance value of the recording medium "S" increases due to the decrease of the humidity of the recording medium "S." Therefore, the electric current applied from the constant-current power supply 4 can be controlled more precisely if the resistance value of the recording medium "S" is detected. For example, in this embodiment, the electric current detecting device 7 detects an amount of the electric current passing through the recording medium "S" and sends a detection output to the control device 11 as illustrated in FIGS. 2 through 6.

The control device 11 calculates the resistance value of the recording medium "S" based on the detection output of the electric current detecting device 7. The control device 11 controls the constant-current power supply 4 to change a value of an electric current voltage applied from the constant-current power supply 4 to the electrode according to the calculated resistance value of the recording medium "S." As a result, stable image transfer efficiency can be obtained.

Specifically, when the amount of the electric current passing through the recording medium "S" detected by the electric current detecting device 7 is large enough, the resistance value of the recording medium "S" is low enough. In this condition, the electric current largely flows in the recording medium "S", and a reactive electric current does not flow to the area where the intermediate transfer element 10*a* and the transfer element 3 directly contact each other.

Accordingly, the value of the electric current voltage applied from the constant-current power supply 4 does not need to be changed.

When the amount of the electric current passing through the recording medium "S" detected by the electric current detecting device 7 is less than a predetermined value, the control device 11 controls the constant-current power supply 4 to change the value of the electric current voltage applied from the constant-current power supply 4 to the electrode in consideration of the resistance value of the recording medium "S" and the resistance value of the elastic member 3*b* of the transfer element 3. As a result, an adequate transfer electric current can be applied to the recording medium "S".

The present invention has been described with respect to the embodiments as illustrated in the figures. However, the present invention is not limited to the embodiments and may be practiced otherwise.

The above-described image forming apparatus may also form single-color images instead of multi-color images.

In the above embodiment, the photoreceptor 8 is shaped in the form of a drum. As an alternative to the drum-shaped photoreceptor 8, a belt-shaped photoreceptor 8 may be employed.

In the above embodiment, the intermediate transfer element 10*a* is the transfer belt. However, the intermediate transfer element 10*a* may be shaped in the form of a drum.

According to the above-described embodiments, the electric current voltage applied to the electrode of the facing member from the constant-current power supply 4 is subjected to a constant-current control. Therefore, a stable transfer electric field can be formed irrespective of the resistance value of the recording medium "S." As a result, a high quality image can be obtained in the image forming apparatus.

Further, in the above-described embodiments, the electrode is provided to form a transfer electric field on the side of the intermediate transfer element 10*a* opposite to the side thereof on which a toner image is carried. Therefore, even though the resistance value of the recording medium "S" is low, electric currents flowing into devices other than the intermediate transfer elements 10*a* which contact the recording medium "S" do not cause the decrease of the transfer electric field, because the flow of the electric currents into the devices occurs after the transfer electric currents from the electrode are used for transferring a toner image from the intermediate transfer element 10*a* to the recording medium "S." As a result, a stable image transfer efficiency can be obtained, and a stable high quality image can be formed in the image forming apparatus.

Numerous additional modifications and variations of the present invention are possible in light of the above teachings. It is therefore to be understood that within the scope of the appended claims, the present invention may be practiced otherwise than as specifically described herein.

What is claimed is:

1. A transfer device that transfers a visual image from an image carrier to a recording medium, comprising:

a first transfer element configured to move and receive the visual image from the image carrier on a first surface of the first transfer element, the first transfer element being in a shape of a belt;

a second transfer element provided opposite to the first surface of the first transfer element to pinch and convey the recording medium through a transfer nip part formed between the first surface of the first transfer element and the second transfer element;

a facing roller provided on a second surface of the first transfer element opposite to the first surface of the first transfer element, the facing roller facing the second transfer element via the first transfer element and including a core metal provided as a centermost portion of the facing roller and functioning as an electrode, and a medium resistance member formed around the core metal and in contact with the first transfer element;

a constant-current power supply configured to apply an electric current voltage to the core metal of the facing roller to transfer the visual image on the first surface of the first transfer element to the recording medium, wherein the electric current voltage applied to the core metal has a polarity equal to a polarity of the visual image and is subjected to a constant-current control; and a lower guide plate at an upstream side of the transfer nip, and an electric current detecting device configured to detect an amount of an electric current passing through the recording medium, and through the lower guide plate, and a control device configured to control the constant-current power supply to change a value of the electric current voltage applied to the core metal based on a detection output of the electric current.

2. The transfer device according to claim 1, wherein a resistance value of the elastic member is in a range of $10^6$ Ωcm to $10^{12}$ Ωcm.

3. The transfer device according to claim 1, further comprising a control device configured to control the constant-current power supply to change a value of the electric current voltage applied to the core metal according to a width of the recording medium.

4. The transfer device according to claim 1, wherein the medium resistance member is an elastic member of medium resistance.

5. An image forming apparatus, comprising:

an image carrier configured to carry a visual image;

a transfer device configured to transfer the visual image from the image carrier to a recording medium, the transfer device including, a first transfer element configured to move and receive the visual image from the image carrier on a first surface of the first transfer element, the first transfer element being in a shape of a belt, a second transfer element provided opposite to the first surface of the first transfer element to pinch and convey the recording medium through a transfer nip part formed between the first surface of the first transfer element and the second transfer element, a facing roller provided on a second surface of the first transfer element opposite to the first surface of the first transfer element, the facing roller facing the second transfer element via the first transfer element and including a core metal provided as a centermost portion of the facing roller and functioning as an electrode, and a medium resistance member formed around the core metal and in contact with the first transfer element, a constant-current power supply configured to apply an electric current voltage to the core metal of the facing roller to transfer the visual image on the first surface of the first transfer element to the recording medium, wherein the electric current voltage applied to the core metal has a polarity equal to a polarity of the visual image and is subjected to a constant-current control; and a lower guide plate at an upstream side of the transfer nip, and an electric current detecting device configured to detect an amount of an electric current passing through the recording medium, and through the lower guide plate, and a control device configured to control the constant-current power supply to change a value of the electric current voltage applied to the core metal based on a detection output of the electric current.

6. The image forming apparatus according to claim 5, wherein a resistance value of the elastic member is in a range of $10^6$ Ωto $10^{12}$ Ωcm.

7. The image forming apparatus according to claim 5, further comprising a recording medium width detecting device configured to detect a width of the recording medium conveyed toward the transfer nip part, wherein the transfer device further comprises a control device configured to control the constant-current power supply to change a value of the electric current voltage applied to the core metal according to a detection output of the recording medium width detecting device.

8. The image forming apparatus according to claim 5, wherein the medium resistance member is an elastic member of medium resistance.

9. An image forming apparatus, comprising: carrying means for carrying a visual image;

transferring means for transferring the visual image from the carrying means to a recording medium, the transferring means including, first transfer means for moving and receiving the visual image from the carrying means on a first surface of the first transfer means, the first transfer means being in a shape of a belt, second transfer means for pinching and conveying the recording medium through a transfer nip part formed between the first surface of the first transfer means and the second transfer means, the second transfer means being provided opposite to the first surface of the first transfer means, a facing roller provided on a second surface of the first transfer means opposite to the first surface of the first transfer means, the facing roller facing the second transfer means via the first transfer means and including a core metal provided as a centermost portion of the facing roller and functioning as an electrode, and a medium resistance member formed around the core metal and in contact with the first transfer element, applying means for applying an electric current voltage to the core metal of the facing roller to transfer the visual image on the first surface of the first transfer means to the recording medium, wherein the electric current voltage applied to the core metal has a polarity equal to a polarity of the visual image and is subjected to a constant-current control, and a lower guide plate at an upstream side of the transfer nip, and electric current detecting means for detecting an amount of an electric current passing through the recording medium, and through the lower guide plate, and controlling means for controlling the applying means to change a value of the electric current voltage applied to the core metal based on a detection output of the electric current.

10. The image forming apparatus according to claim 9, wherein a resistance value of the elastic member is in a range of $10^6$ Ωcm to $10^{12}$ Ωcm.

11. The image forming apparatus according to claim 9, further comprising recording medium width detecting means for detecting a width of the recording medium conveyed toward the transfer nip part, wherein the transferring means further comprises controlling means for controlling the applying means to change a value of the electric current voltage applied to the core metal according to a detection output of the recording medium width detecting means.

12. The image forming apparatus according to claim 9, wherein the medium resistance member is an elastic member of medium resistance.

* * * * *